US005415206A

United States Patent [19]

Egloff

[11] Patent Number: 5,415,206

[45] Date of Patent: May 16, 1995

[54] YARN CLAMP FOR A BRINGER GRIPPER

[75] Inventor: Anton Egloff, Galgenen, Switzerland

[73] Assignee: Sulzer Rueti AG, Rueti, Switzerland

[21] Appl. No.: 96,331

[22] Filed: Jul. 23, 1993

[30] Foreign Application Priority Data

Aug. 25, 1992 [EP] European Pat. Off. ..... 92810648

[51] Int. Cl.[6] ..... D03J 5/06; D03D 47/20

[52] U.S. Cl. ..... 139/196.2; 24/136 R

[58] Field of Search ..... 242/149, 151–153, 242/419.4; 139/196.2, 353, 221–223, 246, 256 R, 215–217, 447, 448; 24/136 R, 115 M, 503, 136 L, 115 R, 511, 489; 114/218, 381

[56] References Cited

U.S. PATENT DOCUMENTS

| | | | |
|---|---|---|---|
| 104,654 | 1/1870 | Searles | 24/511 |
| 864,937 | 9/1907 | Thompson | 114/218 X |
| 2,281,204 | 4/1942 | Raymond | 242/149 X |
| 3,125,978 | 3/1964 | Faul | 114/218 |
| 3,926,225 | 12/1975 | Palencher | 139/196.2 |
| 4,333,649 | 6/1982 | Vaughn et al. | 24/115 M |
| 4,553,294 | 11/1985 | Larsen | 24/489 |
| 5,083,585 | 1/1992 | Rheinganz | 139/196.2 |
| 5,307,751 | 5/1994 | Shell | 114/218 |

FOREIGN PATENT DOCUMENTS

| | | | |
|---|---|---|---|
| 0056259 | 1/1982 | European Pat. Off. | 114/218 |
| 0207533 | 1/1987 | European Pat. Off. . | |
| 1159796 | 7/1958 | France | 24/511 |
| 7039651 | 10/1971 | France . | |
| 7307123 | 9/1974 | France . | |
| 71306 | 4/1915 | Switzerland | 24/489 |
| 508075 | 5/1971 | Switzerland . | |
| 727988 | 4/1955 | United Kingdom | 24/115 M |

*Primary Examiner*—Andrew M. Falik
*Attorney, Agent, or Firm*—Townsend and Townsend Khourie and Crew

[57] ABSTRACT

A yarn clamp made of two clamping members which are arranged with respect to one another so that a clamping gap is formed which has a curved cross-sectional shape of continuously decreasing width in the effective direction and a continuously increasing cross-sectional contour. The holding of a weft yarn in the clamp is effected through elastic deformation of the weft yarn and partial looping of it about one of the clamping members so that damage to the yarn is substantially avoided.

17 Claims, 3 Drawing Sheets

YARN CLAMP FOR A BRINGER GRIPPER

BACKGROUND OF THE INVENTION

The present invention is concerned with a yarn clamp for a bringer gripper.

Swiss patent CH-B-508 075 discloses a yarn clamp which contains a piece of tube with an obliquely cut run-up area and a rod which lies with play in the bore of the piece of tube and is connected firmly to the tube by a piece bent back at the end. The endpiece acts as a spring for radial movements of the rod in the bore. The clearance between the rod and the bore is on all sides equal to the thickness of the yarn, so that the weft yarn for insertion upon reaching the bore increasingly loops round the rod and thereby becomes firmly held. This yarn clamp has the disadvantages that the clearance (gap) is matched to the yarn thickness at the time, and that the yarn is in addition subjected to a clamping action by the resilient rod. Consequently, upon transfer of the yarn, single elemental threads remain behind in the clamping gap, which leads to visible faults in the weave if monofilament or twisted yarn is being handled.

SUMMARY OF THE INVENTION

An objective of the invention is to create a yarn clamp for a bringer gripper in which, while avoiding the aforesaid disadvantages, weft yarns of different diameters are held securely.

The advantages of the yarn clamp made in accordance with the invention are its simple construction together with a secure holding of the weft yarn through elastic deformations of the weft yarn and the partial looping round one of the members of the clamp.

It is of advantage if the areas bounding the clamping gap exhibit a full or partial round, oval, polygonal, or star-shaped cross-sectional contour and if the areas bounding the clamping gap have the same or different cross-sectional contours. In a preferred embodiment the first clamping member exhibits a bore through it, and the second clamping member is a needle with a tapered portion which forms the other area bounding the clamping gap. This has the advantage that without alteration of the cross-sectional contour of the clamping gap the needle may be exchanged to suit weft yarn of another diameter.

It is advantageous if the first and second clamping members are arranged so that they can be shifted with respect to one another to facilitate the pulling in and out of the weft yarn by changing the dimension of the clamping gap. Weft yarn breakage during pulling in and out is thereby substantially prevented. If the second clamping member in its longitudinal extension is supported by the first clamping member outside the clamping gap, the clamping members can act as a one-armed lever. It is of further advantage if the first clamping member is a guide body for fastening to a gripper head to simplify the design of the gripper head.

BRIEF DESCRIPTION OF THE DRAWINGS

FIG. 7 partially illustrates a gripper loom L including a yarn clamp C constructed in accordance with the present invention for grasping a weft yarn 4 and inserting it in a shed S defined by warp yarns W.

DESCRIPTION OF THE PREFERRED EMBODIMENTS

Figure 3:
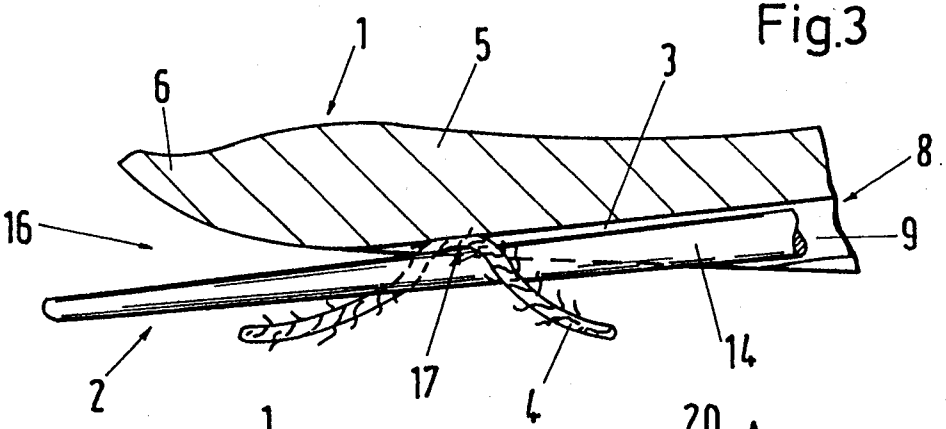
FIG. 3 is a partial detail of FIG. 2 on an enlarged scale and shows a clamped yarn.

The yarn clamp C consists essentially of a body 1 and needle 2 which form a clamping gap 3 for holding a weft yarn 4. For receiving the needle 2 the body has a portion 5 which at the front end exhibits a region 6 of convex form and towards the other end continues into a portion 7 for fastening the body 1 from above onto a gripper housing (not shown). A bore 8 is provided through the body 1, the circumferential area of which forms one area 9 bounding the clamping gap 3. The bore 8 is made on a slant with respect to the underside of the body so that the outlet opening adjoins the convex region 6 of the body 1 (FIG. 3).

The needle has a circular cross-section. Starting from one end, the needle 2 includes a first portion 11 by which the needle 2 is fixed to the body 1, then a second portion 12 which adjoins the first portion 11 and by which the needle 2 is supported in the body 1 and a conical portion 13 which adjoins the second portion 12 and tapers towards the free end and the surface of which forms the other area 14 defining the clamping gap 3.

The needle 2 when arranged in the bore 8 is locked by a member 15. A spring (not shown) is provided, which holds the member 15 in the locking position represented in FIG. 2. Under pressure in the direction of the arrow A the member 15 is shifted against the force of the spring into a release position in which the needle 2 may be replaced or exchanged.

Figure 2:
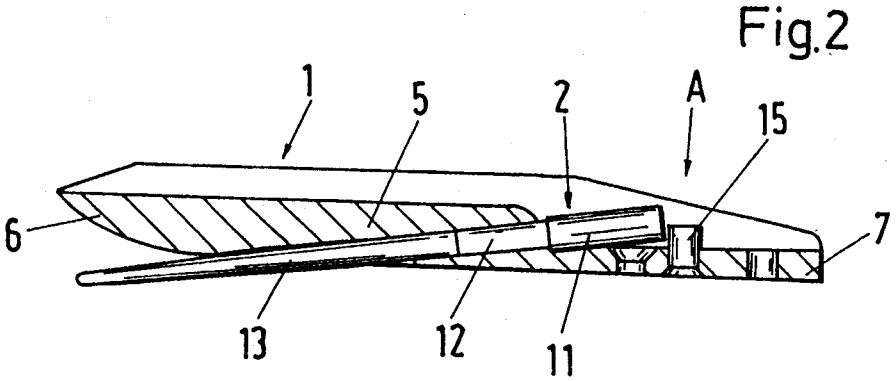
FIG. 2 is a section along the line II—II of FIG. 1.

As shown in FIG. 2 the needle 2 is arranged in the bore in such a way that the conical portion 13 projects at the underside of the body and extends over the convex region 6 of the body 1.

As shown in particular in FIG. 3, this arrangement forms the clamping gap 3 and an entry gap 16 in front thereof. The clamping gap 3 is bounded on one side by the wall of the bore 8 and on the other side by the surface of the conical portion 13 of the needle 2. A clamping gap thereby arises which exhibits a curved cross-sectional shape of continuously decreasing width in the effective or operative direction and a continuously increasing cross-sectional contour.

Upon introducing the yarn into the clamping gap 3 the yarn 4 is deformed, a deformation of the cross-section of the yarn through the narrowing of the clamping gap and a looping of it about the needle 2 as a result of the simultaneous occurrence of the increasing cross-sectional contour of the clamping gap. The clamping and the clamping point 17 are determined by a frictional force developing in the clamping gap, which is dependent upon the pull applied to the yarn, the degree of deformation of the yarn, and the degree of looping of it about the conical portion 13 of the needle 2 (FIG. 3). Through the deformation of the yarn 4 and the degree of looping about of the yarn 4, the individual filaments of the yarn are held against the conical portion 13 of the needle 2.

Through the choice of the width of gap and diameter of yarn the clamping point 17 becomes so located that between the clamped yarn and the bottom of the gap there is a free portion of gap.

This free portion of gap forms a free space for individual filaments or fibers which in pulling out the yarn are pulled out with it. Hence leaving yarn fluff behind in the clamping gap is prevented. This choice further enables yarns of different diameters to be held in the same yarn clamp.

Figure 4:
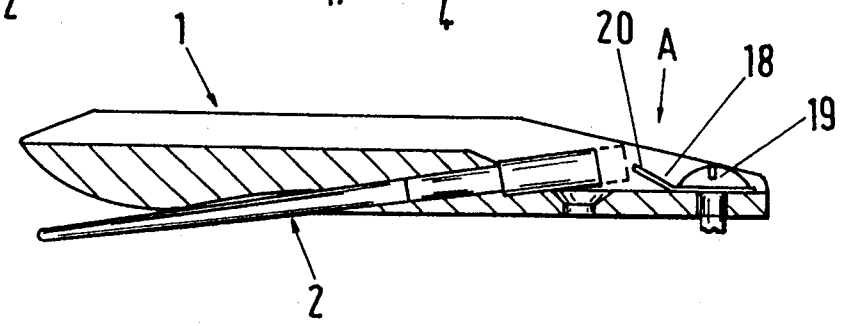
FIG. 4 is a section similar to FIG. 2 and illustrates another embodiment of the yarn clamp of the invention.
Figure 1:
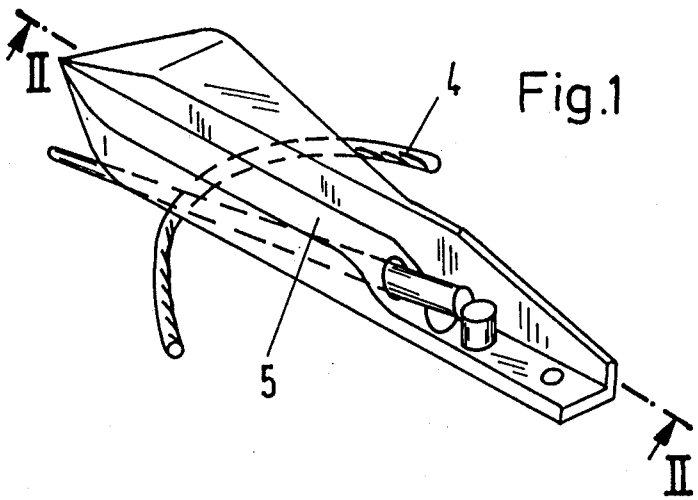
FIG. 1 is a perspective of an embodiment of a yarn clamp made in accordance with the invention.

FIG. 4 shows in embodiment of the yarn clamp in which the needle 2 is arranged so that it can be shifted with respect to the body 1. For limiting the shifting a leaf spring 18 is fastened to the portion 7 of the body 1 by means of a screw 19. The leaf spring 18 has a curved portion 20 the edge of which is intended for contact with the end face of the stop portion 11. As in the case of the embodiment according to FIG. 1 the needle 6 may be replaced or exchanged if the spring portion is brought into a release position by applying pressure in the direction of the arrow A.

Figure 5:
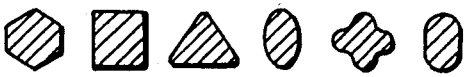
FIG. 5 illustrates different cross-sections for the needle.

FIG. 5 shows different cross-sectional shapes of the conical portion 13 of the needle 2, the circumferential areas of which form an area bounding the clamping gap 3. This area may be a cylindrical area the generatrix of which is a straight line, or an area formed of planar surfaces.

Figure 6:
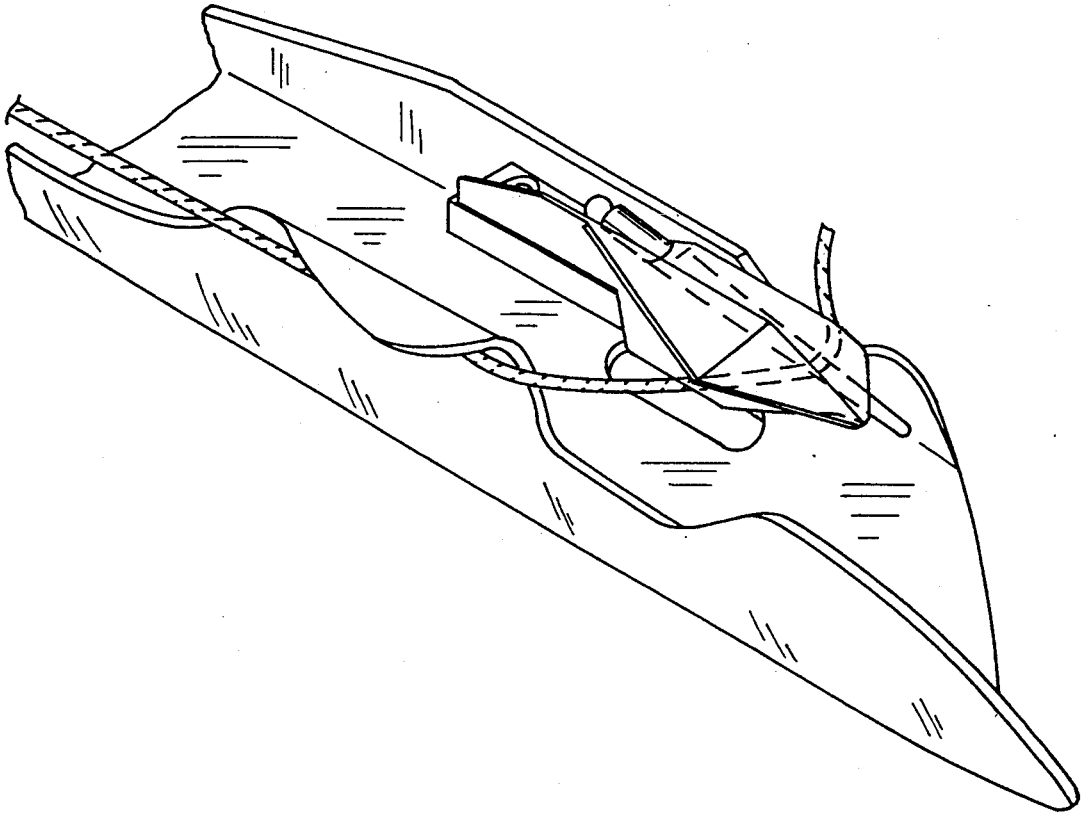
FIG. 6 is a perspective view of a gripper head with a yarn clamp according to FIG. 1.
Figure 7:
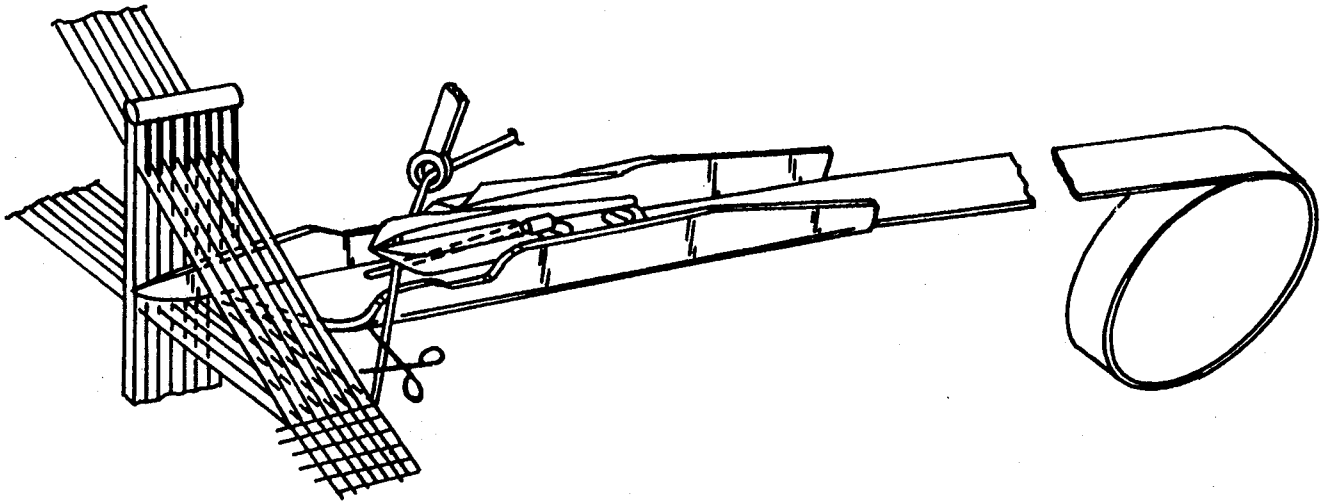
FIG. 7 is a partial, perspective view of a gripper loom fitted with a yarn clamp constructed in accordance with the invention.

FIG. 6 shows an arrangement of a yarn clamp in a gripper body of a gripper loom.

What is claimed is:

1. A yarn clamp adapted to hold a weft yarn for a gripper of a gripper loom, the clamp comprising first and second, elongated clamping members fixed to each other proximate aft ends of the members, the clamping members including opposing, spaced-apart clamping surfaces extending from free ends of the members towards their aft ends and defining between them a clamping gap of a generally curved cross-section which is largest proximate the free ends of the members and which continuously decreases in an operative direction which is transverse to the generally curved cross-section of the clamping gap towards the aft ends of the members so that a weft yarn can be introduced into the gap at the free end of the members and becomes engaged, deformed and frictionally held by the opposing clamping surfaces of the members as the yarn is pulled into the gap in the operative direction.

2. A yarn clamp according to claim 1 wherein the curved, cross-sectional shape of the gap is selected from the group consisting of round, oval, polygonal and star-shaped cross-sectional shapes.

3. A yarn clamp according to claim 1 wherein, in cross-section, the clamping surfaces have like cross-sectional shapes.

4. A yarn clamp according to claim 1 wherein, in cross-section, the clamping surfaces have different cross-sectional shapes.

5. A yarn clamp according to claim 4 wherein the clamping surfaces are defined by straight lines extending in the operative direction.

6. A yarn clamp according to claim 5 wherein at least one of the clamping surfaces has a conical shape.

7. A yarn clamp according to claim 6 wherein another one of the clamping surfaces has a cylindrical shape.

8. A yarn clamp according to claim 1 wherein at least one of the clamping surfaces includes a planar surface.

9. A yarn clamp according to claim 8 wherein the clamping surfaces are entirely defined by a succession of multiple planar surfaces which are angularly aligned with respect to each other.

10. A yarn clamp according to claim 1 wherein one of the clamping surfaces is a concave surface and another ode of the clamping surfaces is a convex surface.

11. A yarn clamp according to claim 1 wherein the first clamping member includes a bore extending in the operative direction and defining a first clamping surface, and wherein the second clamping member comprises a needle secured to the first member and having a tapered portion forming a second clamping surface.

12. A yarn clamp according to claim 11 wherein the bore comprises a first, rear portion, wherein a portion of the needle is disposed in the bore and is fixed to the first member, and wherein a second, forward portion of the bore is coextensive with, spaced from and extends only partially about the tapered portion of the needle so that the yarn receiving gap is defined by the second portion of the bore and the tapered portion of the needle.

13. A yarn clamp according to claim 1 including means permitting relative shifting of the first and second members parallel to the operative direction to thereby vary the cross-sectional size of the clamping gap for facilitating the insertion and withdrawal of the weft yarn into and out of clamping engagement with the clamping surfaces.

14. A yarn clamp according to claim 1 including means defined by the first and second clamping members and located aft of an aft end of the clamping gap for supporting the second clamping member on the first clamping member.

15. A yarn clamp according to claim 1 wherein the first clamping member comprises a guide body adapted for attachment to the gripper of a gripper loom.

16. A yarn clamp adapted to hold a weft yarn for a gripper of a gripper loom comprising first and second clamping members having forward and aft ends and defining first and second, opposite, longitudinally extending and spaced-apart clamping surfaces, the members being secured to each other proximate their aft ends and extending from their aft ends divergingly to their forward ends so that the first and second clamping members define a yarn clamping gap between them which gradually and continuously decreases from their front end towards their aft ends so that yarns of varying cross-sections can be inserted in the clamping gap by moving the yarn in an operative direction towards the aft end of the members until the clamping surfaces deform and frictionally engage the yarn without movement of the members relative to each other.

17. A gripper loom including a bringer gripper for weft yarn and cooperating first and second clamping members mounted on the bringer gripper for releasably gripping the weft yarn, means for securing the first member to the bringer gripper, means for securing the second member to the first member, the first and second members further having forward and aft ends and defining first and second, opposite and spaced-apart yarn clamping surfaces defining an elongated yarn clamping gap of a generally curved cross-section and diverging continuously from proximate the aft ends of the members towards the forward ends of the members so that by inserting the weft yarn in the clamping gap and moving it towards the aft ends of the members the weft yarn becomes engaged and partially deformed by the opposing clamping surfaces of the members and is thereby frictionally held by the members for attachment of the yarn to the gripper.

* * * * *